US009500073B2

(12) United States Patent
Xiao et al.

(10) Patent No.: US 9,500,073 B2
(45) Date of Patent: Nov. 22, 2016

(54) ELECTRICAL SUBMERSIBLE PUMP FLOW METER

(75) Inventors: Jinjiang Xiao, Dhahran (SA); Randall Alan Shepler, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 227 days.

(21) Appl. No.: 13/546,694

(22) Filed: Jul. 11, 2012

(65) Prior Publication Data

US 2013/0081460 A1 Apr. 4, 2013

Related U.S. Application Data

(60) Provisional application No. 61/540,639, filed on Sep. 29, 2011.

(51) Int. Cl.

| | |
|---|---|
| ***E21B 47/10*** | (2012.01) |
| ***E21B 21/08*** | (2006.01) |
| ***E21B 44/00*** | (2006.01) |
| ***E21B 47/00*** | (2012.01) |
| ***E21B 47/06*** | (2012.01) |
| ***E21B 43/12*** | (2006.01) |

(52) U.S. Cl.

CPC ..... *E21B 47/10* (2013.01); *E21B 43/128* (2013.01); *E21B 47/06* (2013.01)

(58) Field of Classification Search

CPC ..... E21B 47/06; F04B 2207/02; G01F 1/36; G01F 1/90

USPC ..... 73/152.29, 152.01–152.62, 151, 73/861–861.41

See application file for complete search history.

(56) References Cited

U.S. PATENT DOCUMENTS

| | | | | |
|---|---|---|---|---|
| 4,397,190 | A * | 8/1983 | Hulin | 73/861.04 |
| 4,829,831 | A | 5/1989 | Kefer et al. | |
| 4,856,344 | A | 8/1989 | Hunt | |
| 5,608,170 | A | 3/1997 | Atkinson et al. | |
| 5,693,891 | A | 12/1997 | Brown et al. | |
| 5,736,650 | A | 4/1998 | Hiron et al. | |

(Continued)

FOREIGN PATENT DOCUMENTS

| | | | |
|---|---|---|---|
| GB | 2411188 | A | 8/2005 |
| WO | 2013049574 | A2 | 4/2013 |

OTHER PUBLICATIONS

Williams, A. J. (Sandy), Demystifying ESPs: A Technique to Make Your ESP Talk to You, 6th European Electric Submersible Pump Round Table, Aberdeen Section, pp. 1-19, Society of Petroleum Engineers.

(Continued)

*Primary Examiner* — Robert Huber
*Assistant Examiner* — Anthony W Megna Fuentes
(74) *Attorney, Agent, or Firm* — Bracewell LLP; Constance G. Rhebergen; Keith R. Derrington

(57) ABSTRACT

An apparatus for metering fluid in a subterranean well includes an electric submersible pump having a motor, a seal section and a pump assembly and a metering assembly. The metering assembly includes an upper pipe section with an outer diameter, the upper pipe section having an upper pressure sensing means, and a lower pipe section with an outer diameter smaller than the outer diameter of the upper pipe section, the lower pipe section having a lower pressure sensing means. A power cable is in electronic communication with the electric submersible pump and with the metering assembly.

9 Claims, 2 Drawing Sheets

(56) References Cited

U.S. PATENT DOCUMENTS

| | | | | |
|---|---|---|---|---|
| 6,776,054 | B1 | 8/2004 | Stephenson et al. | |
| 7,086,294 | B2 | 8/2006 | DeLong | |
| 7,107,860 | B2 | 9/2006 | Jones | |
| 8,330,617 | B2 * | 12/2012 | Chen et al. | 340/854.6 |
| 2005/0039544 | A1 | 2/2005 | Jones | |
| 2006/0131014 | A1 * | 6/2006 | Huang et al. | 166/250.07 |
| 2008/0098825 | A1 | 5/2008 | Huntsman et al. | |
| 2008/0264182 | A1 | 10/2008 | Jones et al. | |
| 2009/0293634 | A1 * | 12/2009 | Ong | 73/861.04 |
| 2009/0308601 | A1 * | 12/2009 | Poe, Jr. | E21B 47/10 166/250.01 |
| 2010/0067329 | A1 * | 3/2010 | Edwards et al. | 367/82 |
| 2010/0194585 | A1 | 8/2010 | Skinner et al. | |
| 2010/0199780 | A1 * | 8/2010 | Ong | 73/861.04 |
| 2011/0083839 | A1 * | 4/2011 | McCoy et al. | 166/68.5 |
| 2015/0176397 | A1 * | 6/2015 | Shanks | H04B 3/54 340/854.9 |

OTHER PUBLICATIONS http://www.weatherford.com/Products/Production/FlowMeasurement/RedEye%C2%AE2GWater-CutMeter/.

International Search Report and Written Opinion issued in related International Application PCT/US2012/057925, dated Oct. 30, 2013, 10 pages.

* cited by examiner

ELECTRICAL SUBMERSIBLE PUMP FLOW METER

CROSS-REFERENCE TO RELATED APPLICATION

This application claims priority to provisional application 61/540,639 filed Sep. 29, 2011.

BACKGROUND OF THE INVENTION

1. Field of the Invention

The present invention relates to electrical submersible pumps. More specifically, the invention relates a flow meter used in conjunction with an electrical submersible pump.

2. Description of the Related Art

In hydrocarbon developments, it is common practice to use electric submersible pumping systems (ESPs) as a primary form of artificial lift. ESPs often use downhole monitoring tools to supply both temperature and pressure readings from different locations on the ESP. For example, intake pressure, discharge pressure, and motor temperature, as well as other readings may be taken on the ESP.

If wells are producing below bubble point pressure, the liberated gas, at the surface, may not allow the surface meters to provide accurate flow rates. To replace the surface single phase meters with multi-phase meters can cost tens of thousands of dollars per well. Downhole at the ESP all wells are producing with intake pressures well above the bubble point pressure. Therefore, being able to measure flow rate down hole at the ESP would allow for an accurate flow meter that will assist immensely in extending the life of the ESPs. Therefore, a low cost and accurate flow meter that will assist immensely in extending the life of the ESPs that incorporates these theories would be desirable.

SUMMARY OF THE INVENTION

Embodiments of the current application provide a method and apparatus for addressing the shortcomings of the current art, as discussed above.

By adding a pressure sensing means to existing ESP monitoring tools a reliable cost affective single phase flow meter is obtained. This invention expands the capability of ESP monitoring tools by adding single phase oil-water flow meter capability through the addition of sensors below the ESP. Just as the ESP monitoring tool sensor data is now transmitted by the existing ESP cable, the flow meter will be able to do the same with communication on power. This will provide the capability of monitoring real time flow rates to improve the operational performance of the ESPs. The cost of adding a means for measuring flow rate downhole would be substantially absorbed by the already existing need for an ESP pressure or temperature sensor and the ESP power cable which will also be used to transmit the flow meter data, in real time to surface.

The flow meter of the current application is simple in design, has no moving parts and can utilize existing ESP monitoring tool and power cable for data transmission. Application of embodiments of the current application allows for a cost effective means of providing valuable information for improving the life of the ESP.

An apparatus for metering fluid in a subterranean well includes an electric submersible pump comprising a motor, a seal section and a pump assembly and a metering assembly. The metering assembly includes an upper pipe section with an outer diameter, the upper pipe section having an upper pressure sensing means and a lower pipe section with an outer diameter smaller than the outer diameter of the upper pipe section, the lower pipe section having a lower pressure sensing means. A power cable in electronic communication with the electric submersible pump and with the metering assembly.

The metering assembly may be located either above or below the electric submersible pump. The power cable may be connected to the motor and operable to transmit data from pressure sensors. A tapered pipe section may be located between the upper pipe section and the lower pipe section, to create a smooth transition between the upper pipe section and the lower pipe section. The upper and lower pressure sensing means may either have two flow pressure sensors or it may be a single pressure differential sensor.

In an alternative embodiment, a method for metering fluid in a subterranean well include the steps of installing an electric submersible pump in a subterranean well, the electric submersible pump comprising a motor, a seal section and a pump assembly and connecting a metering to the electric submersible pump, the metering assembly comprising an upper pipe section with an outer diameter, the upper pipe section comprising an upper pressure sensing means, and a lower pipe section with an outer diameter smaller than the outer diameter of the upper pipe section, the lower pipe section comprising a lower pressure sensing means. A power cable is installed in the subterranean well, the power cable being in electronic communication with the motor and with the metering assembly.

The metering assembly may be connected to the bottom or the top of the electric submersible pump. When it is connected to the top, the pressure sensing means may collect data from fluid flowing inside of the upper and lower pipe sections. When the metering assembly is connected to the bottom of the electric submersible pump, the pressure sensing means may collect data from fluid flowing exterior to the upper and lower pipe sections. Data from the pressure sensors may be transmitted to the surface.

In one embodiment, a production water cut and fluid density may be calculated with data transmitted from the lower pressure sensing means after determining a pressure differential at the lower pressure sensing means. In this embodiment, the fluid flow rate may be calculated with data transmitted from the upper pressure sensing means after determining a pressure differential at the upper pressure sensing means. In an alternative embodiment, a production water cut and fluid density may be calculated with data transmitted from the upper pressure sensing means after determining a pressure differential at the upper pressure sensing means. In the alternative embodiment, the fluid flow rate may be calculated with data transmitted from the lower pressure sensing means after determining a pressure differential at the lower pressure sensing means.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
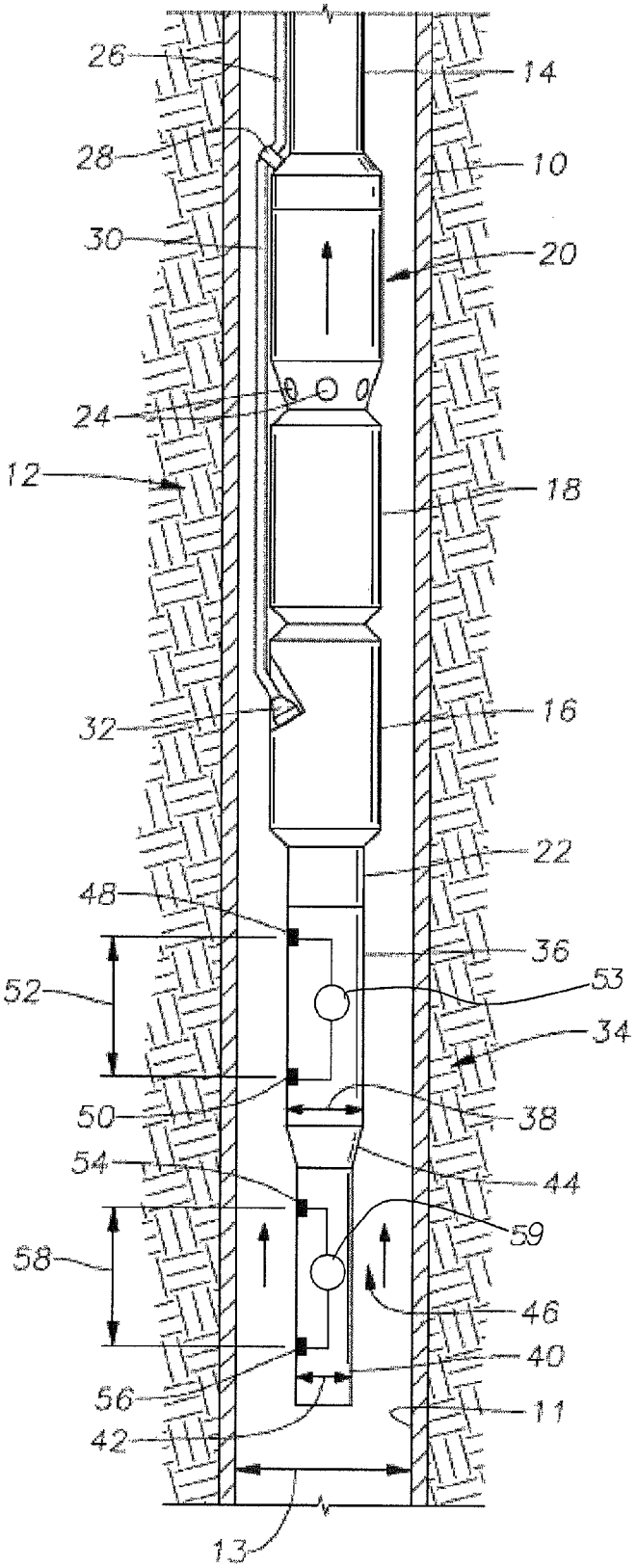
FIG. 1 is an elevational view of an electrical submersible pump with a flow meter of an embodiment of the current application.

FIG. 1 is an elevational view of a well 10 having an electric submersible pump ("ESP") 12 disposed therein, mounted to a string of tubing 14. Well 10 has in internal bore 11 with a diameter 13. ESP 12 includes an electric motor 16, and a seal section 18 disposed above motor 16. Seal section 18 seals well fluid from entry into motor 16. ESP also includes a pump section comprising pump assembly 20 located above seal section 18. The pump assembly may include, for example, a rotary pump such as a centrifugal pump. Pump assembly 20 could alternatively be a progressing cavity pump, which has a helical rotor that rotates within an elastomeric stator. An ESP monitoring tool 22 is located below electric motor 16. Monitoring tool 22 may measure, for example, various pressures, temperatures, and vibrations. ESP 12 is used to pump well fluids from within the well 10 to the surface. Fluid inlets 24 located on pump assembly 20 which create a passage for receiving fluid into ESP 12.

In the embodiment of FIG. 1, a power cable 26 extends alongside production tubing 14, terminating in a splice or connector 28 that electrically couples cable 26 to a second power cable, or motor lead 30. Motor lead 30 connects to a pothead connector 32 that electrically connects and secures motor lead 30 to electric motor 16.

Below the ESP 12 is a metering assembly 34. Metering assembly 34 comprises an upper pipe section 36 which is attached to the bottom the monitoring tool 22 of ESP 12. In alternative embodiments, monitoring tool 22 may not be a part of ESP 12 and metering assembly 34 would be attached directly to the bottom of motor 16. Upper pipe section 36 has an external diameter 38. Metering assembly 34 also comprises a lower pipe section 40, which is located below upper pipe section 36. Lower pipe section 40 has an external diameter 42 which is smaller than the external diameter 38 of upper pipe section 36. A tapered intermediate pipe section 44 mates the upper pipe section 36 to lower pipe section 40. The intermediate pipe section 44 is tapered in such a manner to create a smooth transition between upper pipe section 36 to lower pipe section 40 to minimize the sudden flow disturbance and pressure losses within bore 11.

As an example, each of upper pipe section 36 and lower pipe section 40 may have a length of 15 to 20 feet. For a metering assembly 34 deployed inside a well 10 with an internal diameter of 7 inches, which may be, for example, the internal diameter of the casing completion, the external diameter 42 of lower pipe section 40 may be 3.5 inches or smaller and the external diameter 38 of upper pipe section 36 my be 5.5 inches. As a second example, for a metering assembly 34 deployed inside a well 10 with an internal diameter of 9⅝ inches, which may be, for example, the internal diameter of the casing completion, the external diameter 42 of lower pipe section 40 may be 4.5 inches or smaller and the external diameter 38 of upper pipe section 36 my be 7 inches.

As described, the external diameters 38, 42 of upper and lower pipe sections 36, 40 are smaller than the internal diameter 13 of the bore 11 of well 10. The annular spaces between external diameters 38, 42 and bore 11 create an annular flow path 46 for the passage of fluids within the well as the fluids are drawn upwards towards fluid inlets 24 of pump assembly 20. A pressure sensing means is located on upper pipe section 36 and lower pipe section 40. The upper pressure sensing means may comprise two upper flow pressure sensors 48, 50 located on upper pipe section 36. The upper sensors 48, 50 are located at an upper distance 52 apart from each other and are capable of collecting data from fluid flowing exterior to the upper and lower pipe sections 36, 40 in the annular flow path 46. Upper distance 52 may be, for example, 10 to 15 feet. Alternatively, an upper pressure differential sensor 53 may be used to measure the pressure difference between the two upper locations. A pressure sensing means is located on upper pipe section 36 and lower pipe section 40. The lower pressure sensing means may comprise two lower flow pressure sensors 54, 56 located on lower pipe section 40. The lower sensors 54, 56 are located at a lower distance 58 apart from each other. Lower distance 58 may be, for example, 10 to 15 feet. Alternatively, a lower pressure differential sensor 59 may be used to measure the pressure difference between the two lower locations.

Because of the differences in the outer diameter 38 of upper pipe section of upper pipe section 36 and outer diameter 42 of lower pipe section 40, two distinctive flow regimes are created along the annulus flow path 46, one along lower distance 58 and another along upper distance 52. A first pressure loss may be measured over lower distance 58. The first pressure loss is determined by measuring a pressure with first lower senor 56 and second lower sensor 54 and finding the difference between the two pressure readings. Alternatively, a single pressure differential sensor may measure the first pressure loss. Because of the relatively smaller external diameter 42 of lower pipe section 40, the first pressure loss is dominated by gravitational losses.

A second pressure loss may be measured over upper distance 52. The second pressure loss is determined by measuring a pressure with first upper senor 50 and second upper sensor 48 and finding the difference between the two pressure readings. Alternatively, a single pressure differential sensor may measure the second pressure loss. Because of the relatively larger external diameter 38 of upper pipe section 36, the second pressure loss is affected by both gravitational loss and frictional loss. The pressure loss data collected by sensors 48, 50, 54, and 56 are transmitted to surface by way of the power cable 26, which is in electrical communication with the metering assembly 34. The flow rate of the fluids within well 10 and the water cut of such fluids can be calculated with this pressure loss data using hydraulic equations as further describe herein. More specifically, the first pressure loss, calculated with data from the first lower senor 56 and second lower sensor 54, or with a single pressure differential sensor, can be used to calculate oil-water mixture density and the production water cut and the second pressure loss, calculated with data from first upper senor 50 and second upper sensor 48, or with a single pressure differential sensor, can be used to calculate oil-water mixture flowrate.

Figure 2:
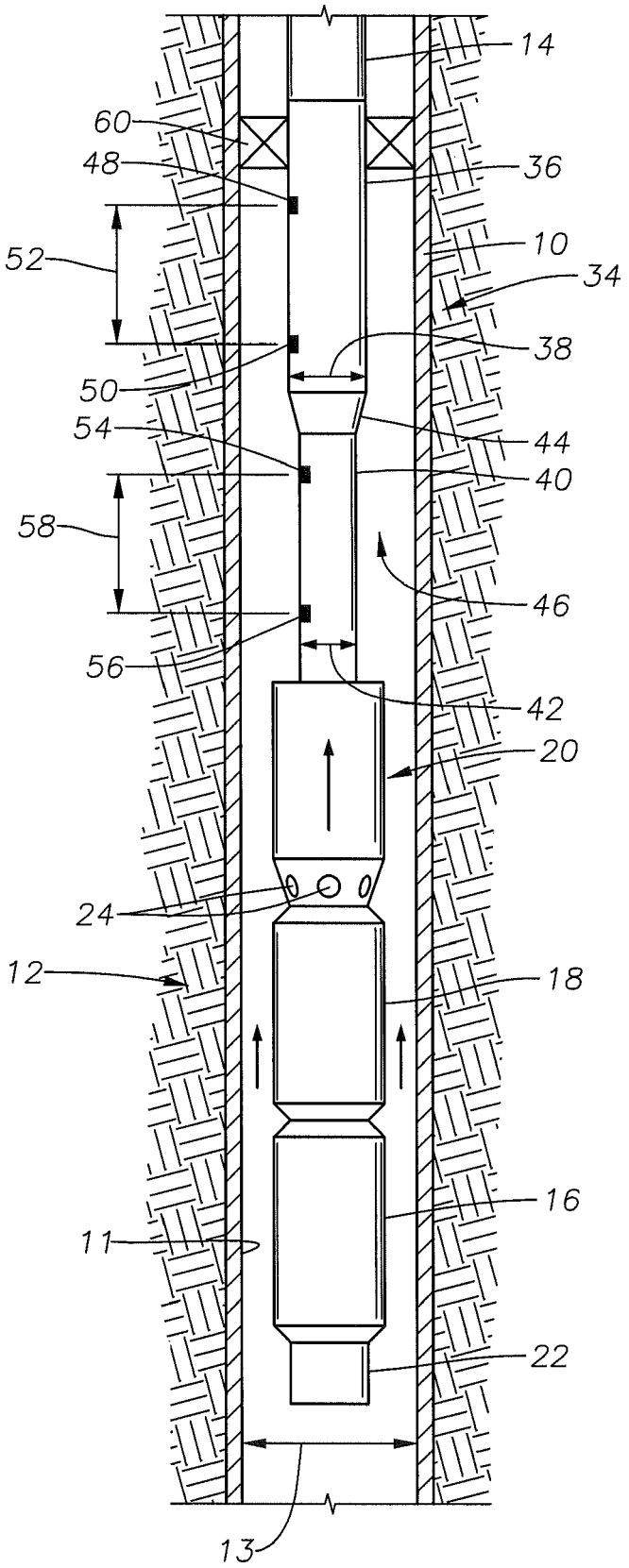
FIG. 2 is an elevational view of an electrical submersible pump with a flow meter of an alternative embodiment of the current application.

In the alternative embodiment of FIG. 2, ESP 12 with electric motor 16, seal section 18 disposed above motor 16 and pump assembly 20 located above seal section 18, is located below metering assembly 34. An ESP monitoring tool 22 may be located below electric motor 16. Fluid inlets 24 on pump assembly 20 create a passage for receiving fluid into ESP 12. The fluids then continue upwards within lower pipe section 40 and upper pipe section 36.

Metering assembly 34 with upper pipe section 36 and lower pipe section 40, are located above ESP 12, with lower pipe section 40 being connected to pump assembly 20. Lower pipe section 40 has an external diameter 42 which is smaller than the external diameter 38 of upper pipe section 36. A tapered intermediate pipe section 44 mates the upper pipe section 36 to lower pipe section 40. The intermediate pipe section 44 is tapered in such a manner to create a smooth transition between upper pipe section 36 to lower pipe section 40 to minimize the sudden flow disturbance and pressure losses within bore 11.

As an example, each of upper pipe section 36 and lower pipe section 40 may have a length of 15 to 20 feet. For a metering assembly 34 deployed inside a well 10 with an internal diameter of 7 inches, which may be, for example, the internal diameter of the casing completion, the external diameter 42 of lower pipe section 40 may be 3.5 inches or smaller and the external diameter 38 of upper pipe section 36 my be 5.5 inches. As a second example, for a metering assembly 34 deployed inside a well 10 with an internal diameter of 9⅝ inches, which may be, for example, the internal diameter of the casing completion, the external diameter 42 of lower pipe section 40 may be 4.5 inches or smaller and the external diameter 38 of upper pipe section 36 my be 7 inches.

As described, the external diameters 38, 42 of upper and lower pipe sections 36, 40 are smaller than the internal diameter 13 of the bore 11 of well 10. A packer 60 is sealingly engaged between upper pipe section 36 and the bore 11. Packer 60 seals flow path 46 so that fluids cannot travel further upwards within the wellbore 11 and instead are transported to the surface through tubing 14.

A pressure sensing means is located on upper pipe section 36 and lower pipe section 40. The upper pressure sensing means may comprise two upper flow pressure sensors 48, 50 are located on upper pipe section 36. The upper sensors 48, 50 are located at an upper distance 52 apart from each other. Upper distance 52 may be, for example, 10 to 15 feet. Alternatively, a single pressure differential sensor may be used to measure the pressure difference between the two upper locations. The lower pressure sensing means may comprise two lower flow pressure sensors 54, 56 located on lower pipe section 40. The lower sensors 54, 56 are located at a lower distance 58 apart from each other. Lower distance 58 may be, for example, 10 to 15 feet. Alternatively, a single pressure differential sensor may be used to measure the pressure difference between the two lower locations. The sensor means of FIG. 2 is operable to collect data from a fluid flowing inside of lower pipe section 40 and upper pipe section 36

Because of the differences in the outer diameter 38 of upper pipe section of upper pipe section 36 and outer diameter 42 of lower pipe section 40, two distinctive flow regimes are created, one along lower distance 58 and another along upper distance 52. A first pressure loss may be measured over lower distance 58. The first pressure loss is determined by measuring a pressure with first lower senor 56 and second lower sensor 54 and finding the difference between the two pressure readings. Alternatively, a single pressure differential sensor can measure the first pressure loss. Because of the relatively smaller external diameter 42 of lower pipe section 40, the first pressure loss is dominated by both gravitational and friction losses.

A second pressure loss may be measured over upper distance 52. The second pressure loss is determined by measuring a pressure with first upper senor 50 and second upper sensor 48 and finding the difference between the two pressure readings. Alternatively, a single pressure differential sensor can measure the second pressure loss. Because of the relatively larger external diameter 38 of upper pipe section 36 and lower flow velocity in this region, the second pressure loss is affected only by gravitational loss.

The pressure loss data collected by sensors 48, 50, 54, and 56 are transmitted to surface by way of the power cable 26 (FIG. 1) which is in electronic communication with metering assembly 34. The flow rate of the fluids within well 10, the fluid density, and the water cut of such fluids can be calculated with this pressure loss data using hydraulic equations as further describe herein. More specifically, the first pressure loss, calculated with data from the first upper senor 48 and second upper sensor 50, or with a single pressure differential sensor, can be used to calculate oil-water mixture density and the production water cut and the second pressure loss, calculated with data from first lower senor 54 and second lower sensor 56, or with a single pressure differential sensor, can be used to calculate oil-water mixture flowrate.

In the embodiment of FIG. 1, the water cut may be calculated by first finding the pressure gradient over lower distance 58. This can be calculated in psi/ft at flow regime one can be calculated as $DP_1/L_1$. Because the pressure loss is dominated by gravitational loss:

$$PG_1 = \frac{DP_1}{L_1} = \frac{g}{g_C}\frac{\rho_m}{14_4} \qquad \text{eq. 1}$$

Where g is the gravitational acceleration, 32.2 ft/sec$^2$, $g_c$ is a unit conversion factor, 32.2 lbm-ft/lbf-sec$^2$, and $\rho_m$ is the oil-water mixture density in lbm/ft$^3$. After determining $\rho_m$ from eq. 1, production water cut can be calculated. A similar analysis could be performed over upper distance 52 of the embodiment of FIG. 2 because this second pressure loss is affected only by gravitational loss.

Returning the embodiment of FIG. 1, the pressure gradient in psi/ft can also be found over upper distance 52 and expressed as $DP_2/L_2$. Because pressure loss is affected by both gravitational and frictional losses, the frictional pressure gradient can be given by:

$$PG_2 - PG_1 = \frac{f\rho_m v_m^2}{24 g_C D_h} \qquad \text{eq. 2}$$

Where $v_m$ is the oil-water mixture velocity in ft/sec in upper distance 52, $D_h$ is the hydraulic diameter for the annulus in inches, calculated as internal diameter 13 minus external diameter 38. f is the friction factor. A similar analysis would also apply to the lower distance 58 of the embodiment of FIG. 2 where the first pressure loss is dominated by both gravitational and friction losses.

The friction factor is a function of Reynolds number and roughness, and can be determined from Moody's chart or empirical correlations. Eq. 2 can be used iteratively to obtain the mixture velocity and the total oil-water flowrate. With water cut calculated previously, the individual oil and water rates can be easily calculated.

Although the present invention has been described in detail, it should be understood that various changes, substitutions, and alterations can be made hereupon without departing from the principle and scope of the invention.

Accordingly, the scope of the present invention should be determined by the following claims and their appropriate legal equivalents.

The singular forms "a", "an" and "the" include plural referents, unless the context clearly dictates otherwise. Optional or optionally means that the subsequently described event or circumstances may or may not occur. The description includes instances where the event or circumstance occurs and instances where it does not occur. Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

What is claimed is:

1. A method for metering fluid in a subterranean well comprising: (a) deploying an electric submersible pump in the subterranean well to define an annulus, the electric submersible pump comprising a motor, a seal section and a pump assembly; (b) flowing fluid through the annulus and to the pump assembly to create a flow of fluid; (c) measuring pressure at axially spaced apart locations in the flow of fluid along a first axial space where pressure losses in the flow of fluid include gravitational and frictional losses; (d) measuring pressure at axially spaced apart locations in the flow of fluid along a second axial space, that is axially disposed from the first axial space, and where pressure losses in the flow of fluid comprise gravitational losses and frictional losses, wherein the gravitational losses exceed the frictional losses; (e) estimating the pressure differential between the axially space apart locations along the second axial space with the equation $PG=(g)(\rho_m)/((g_c)(144))$; and (f) communicating pressure loss data along a power cable that is in electronic communication with the motor and with a metering assembly that measures pressure.

2. The method of claim 1, wherein a cross sectional area of the flow of fluid along the first axial location is less than a cross sectional area of the flow of fluid along the second axial location.

3. The method of claim 2, further comprising:

estimating a flowrate of the flow of fluid based on a difference of a pressure gradient along the first axial location and a pressure gradient along the second axial location.

4. The method of claim 2, further comprising:

using a second sensing means to measure pressure at the axially spaced apart locations in the flow of fluid along the second axial space, and calculating a fluid density and a production water cut with data transmitted from the second sensing means; and using a first sensing means to measure pressure at the axially spaced apart locations in the flow of fluid along the first axial space, and calculating a fluid flow rate of an oil and water mixture with data from the first sensing means.

5. The method of claim 4, wherein:

the first and second sensing means are disposed upstream in the flow of fluid from an inlet to the pump assembly and outside of a flowmeter housing that couples to the pump assembly.

6. The method of claim 1, wherein the step of measuring pressure is performed with the metering assembly that comprises, an upper pipe section having an outer diameter less than an inner diameter of the well, and that is strategically sized so that when the upper pipe section is disposed in the well, a pressure loss of fluid flowing between the upper pipe section and walls of the well comprises gravitational losses and frictional losses of the fluid; upper pressure sensors on an outer surface of the upper pipe section and that are axially spaced apart at locations where the upper pipe section diameter is the same and that are disposed to sense pressure adjacent the outer surface of the upper pipe section; an upper pressure differential sensor in communication with the upper pressure sensors so that measuring a pressure differential with the upper pressure differential sensor senses a pressure loss of the fluid flowing between the upper pipe section and walls of the well, and which provides information related to an estimate of a total flow rate of oil and water from a flow of fluid flowing past the metering assembly; a lower pipe section with an outer diameter smaller than the outer diameter of the upper pipe section, and that is strategically sized so that when the lower pipe section is disposed in the well, a pressure loss of fluid flowing between the lower pipe section and walls of the well is estimated by ignoring frictional losses and considering gravitational losses, and by using the equation: $PG=(g)(\rho_m)/((g_c)(144))$; lower pressure sensors on an outer surface of the lower pipe section and that are axially spaced apart at locations where the lower pipe section diameter is the same and that are disposed to sense pressure adjacent the outer surface of the lower pipe section; and a lower pressure differential sensor in communication with the lower pressure sensors, so that measuring a pressure differential with the lower pressure differential sensor provides a pressure loss affected by gravitational losses, and which estimates a water cut in the flow of fluid.

7. The method of claim 6, wherein the metering assembly is located below the electric submersible pump.

8. The method of claim 6, wherein a flowrate of fluid flowing in the well is determined based on a difference of pressure gradients of fluid flowing adjacent the upper and lower pipe sections.

9. The method of claim 6, wherein the metering assembly further comprises a tapered pipe section located between the upper pipe section and the lower pipe section, operable to create a smooth transition between the upper pipe section and the lower pipe section.

* * * * *